US009753474B2

(12) United States Patent
Zhang et al.

(10) Patent No.: US 9,753,474 B2
(45) Date of Patent: Sep. 5, 2017

(54) LOW-POWER LOW-DROPOUT VOLTAGE REGULATORS WITH HIGH POWER SUPPLY REJECTION AND FAST SETTLING PERFORMANCE

(71) Applicant: BROADCOM CORPORATION, Irvine, CA (US)

(72) Inventors: Jinghua Zhang, Singapore (SG); Ricky Setiawan, Singapore (SG); Jeffrey Norwood Harrison, Carlingford (AU)

(73) Assignee: AVAGO TECHNOLOGIES GENERAL IP (SINGAPORE) PTE. LTD., Singapore (SG)

( * ) Notice: Subject to any disclaimer, the term of this patent is extended or adjusted under 35 U.S.C. 154(b) by 438 days.

(21) Appl. No.: 14/173,742

(22) Filed: Feb. 5, 2014

(65) Prior Publication Data

US 2015/0198960 A1 Jul. 16, 2015

Related U.S. Application Data

(60) Provisional application No. 61/927,427, filed on Jan. 14, 2014.

(51) Int. Cl.
*G05F 1/56* (2006.01)
*G05F 1/575* (2006.01)

(52) U.S. Cl.
CPC ..... *G05F 1/575* (2013.01); *G05F 1/56* (2013.01)

(58) Field of Classification Search
CPC ..... G05F 1/56; G05F 1/575
See application file for complete search history.

(56) References Cited

U.S. PATENT DOCUMENTS 6,225,857 B1 * 5/2001 Brokaw ..... G05F 1/575 327/540
6,556,083 B2 * 4/2003 Kadanka ..... H03F 1/086 330/109
8,604,762 B2 * 12/2013 Bakkaloglu ..... H03F 1/086 323/280
8,953,364 B2 * 2/2015 Hollis ..... G11C 29/1201 365/149
2004/0080367 A1 * 4/2004 Crain ..... H03F 3/45219 330/253
2010/0156362 A1 * 6/2010 Xle ..... G05F 1/565 323/273

(Continued)

OTHER PUBLICATIONS

Easwaran, "A Low Power NMOS LDO in the Philips CO50PMU Process," Mar. 2006, Masters Thesis, University of Twente, retrieved from http://eprints.eemcs.utwente.nl/8601/01/Easwaran_S._Navaneeth._MSc2006_A_Low_Power_NMOS_LDO_in_the_Philips_CO50PMU_Process.pdf.

*Primary Examiner* — Gary L Laxton
*Assistant Examiner* — Lakaisha Jackson
(74) *Attorney, Agent, or Firm* — McDermott Will & Emery LLP

(57) ABSTRACT

A low-power low-dropout (LDO) voltage regulator device includes an error amplifier, a level-shifter circuit, and an NMOS pass transistor. The error amplifier compares a sampled portion of a regulated output voltage of the LDO voltage regulator with a reference voltage and generates an error signal. The level-shifter circuit is coupled to the error amplifier. The NMOS pass transistor provides the regulated output voltage with low dropout operation. The level-shifter circuit can shift a voltage level of the error signal to facilitate the low dropout operation of the NMOS pass transistor.

20 Claims, 5 Drawing Sheets

(56) References Cited

U.S. PATENT DOCUMENTS

| | | | | |
|---|---|---|---|---|
| 2011/0156670 | A1 | 6/2011 | Tadeparthy et al. | |
| 2012/0176107 | A1 | 7/2012 | Shrivas et al. | |
| 2013/0063637 | A1* | 3/2013 | Ebihara | H04N 5/3741 348/300 |
| 2013/0176006 | A1 | 7/2013 | van Ettinger et al. | |
| 2014/0340067 | A1* | 11/2014 | Zhong | G05F 3/08 323/311 |

* cited by examiner

LOW-POWER LOW-DROPOUT VOLTAGE REGULATORS WITH HIGH POWER SUPPLY REJECTION AND FAST SETTLING PERFORMANCE

CROSS-REFERENCE TO RELATED APPLICATIONS

This application claims the benefit of priority under 35 U.S.C. §119 from U.S. Provisional Patent Application 61/927,427 filed Jan. 14, 2014, which is incorporated herein by reference in its entirety.

TECHNICAL FIELD

The present description relates generally to power supplies, and more particularly, but not exclusively, to low-power low-dropout (LDO) voltage regulators with high power supply rejection and fast settling performance.

BACKGROUND

Switching regulators are commonly used in many communication devices for providing one or more regulated supply voltages with high efficiency. In communication devices including low-noise radio-frequency (RF) and analog circuits, which are less tolerant to digital noise, the switching regulator has to be followed by a low-dropout (LDO) voltage regulator. The LDO voltage regulator can eliminate much of the ripples in the switching regulator output and provides a clean supply for the RF and/or analog circuitry. Conventional voltage regulators, which use a PMOS as the pass transistor, can achieve low-dropout operation, and show good power efficiency. However, the PMOS pass transistor presents low impedance to the power supply, and the conventional voltage regulators may have poor performance with respect to power supply rejection (PSR) at high frequencies, where the loop gain drops to near or less than 0 dB.

Traditional solutions also tend to have slow settling time, which can limit the power-up and power-down time of the RF and/or analog circuitry. The settling time is decided by the unity-gain bandwidth (UGB) of the loop. The higher the UGB the lower is the settling time. For stability reasons, the UGB has to be lower than the non-dominant pole ($P_{nd}$) of the transfer function of the loop. In conventional LDO voltage regulators, the high output impedance of the PMOS pass transistor leads to a low $P_{nd}$ as well as a low UGB, which result in long settling times. Some of the existing LDO voltage regulator designs, which use native devices as the pass transistor, may suffer from poor power efficiency and may not be compatible with advanced processes such as 16 nano-meter finFET. Others use charge pumps and RC filters, which results in increased complexity and chip area.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

The subject technology may provide a device and implementation for providing a low-power low dropout (LDO) voltage regulator with high power-supply rejection (PSR) and fast settling performance. The subject technology provides a number of advantageous features such as achieving higher PSR at high frequencies (e.g., 10 dB at 100 MHz) and a settling time value that is significantly (e.g., more than 60%) lower than the existing solutions.

Figure 1A:
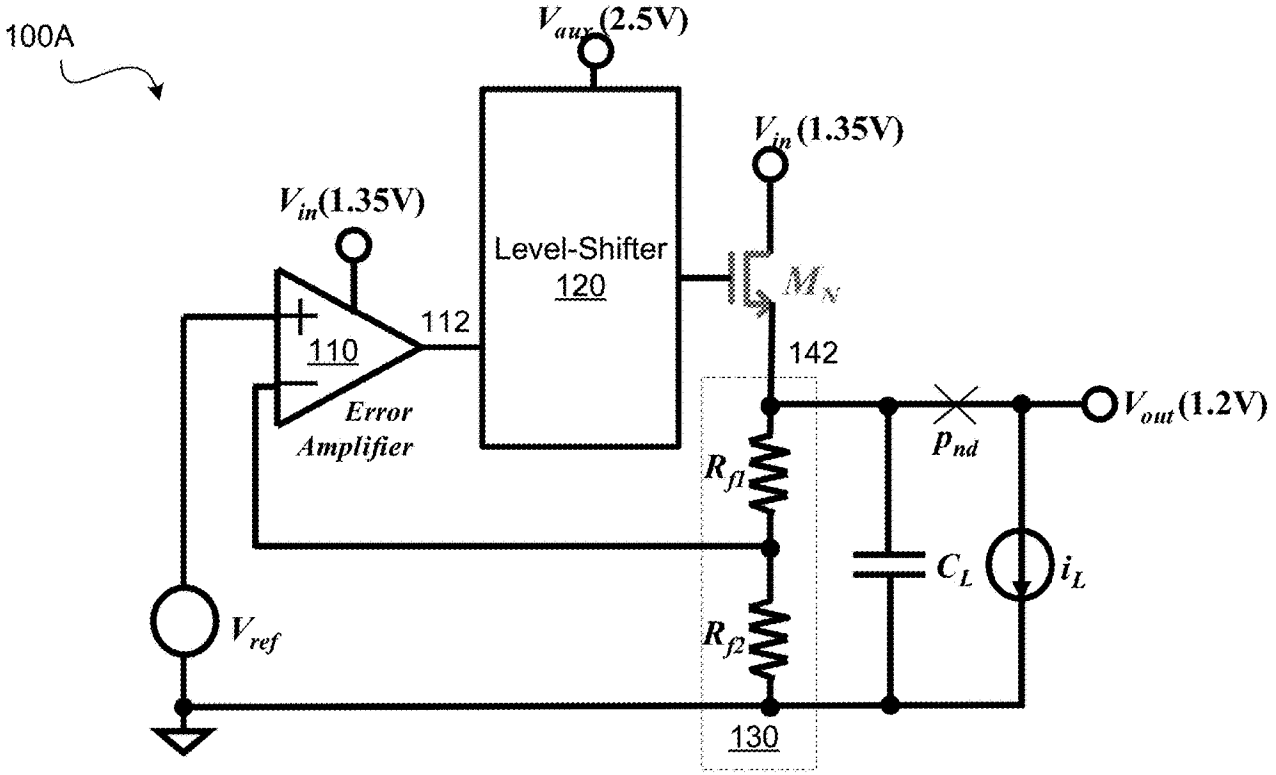
FIGS. 1A-1B illustrate examples of a low-power low-dropout (LDO) voltage regulator device in accordance with one or more implementations.
Figure 1B:
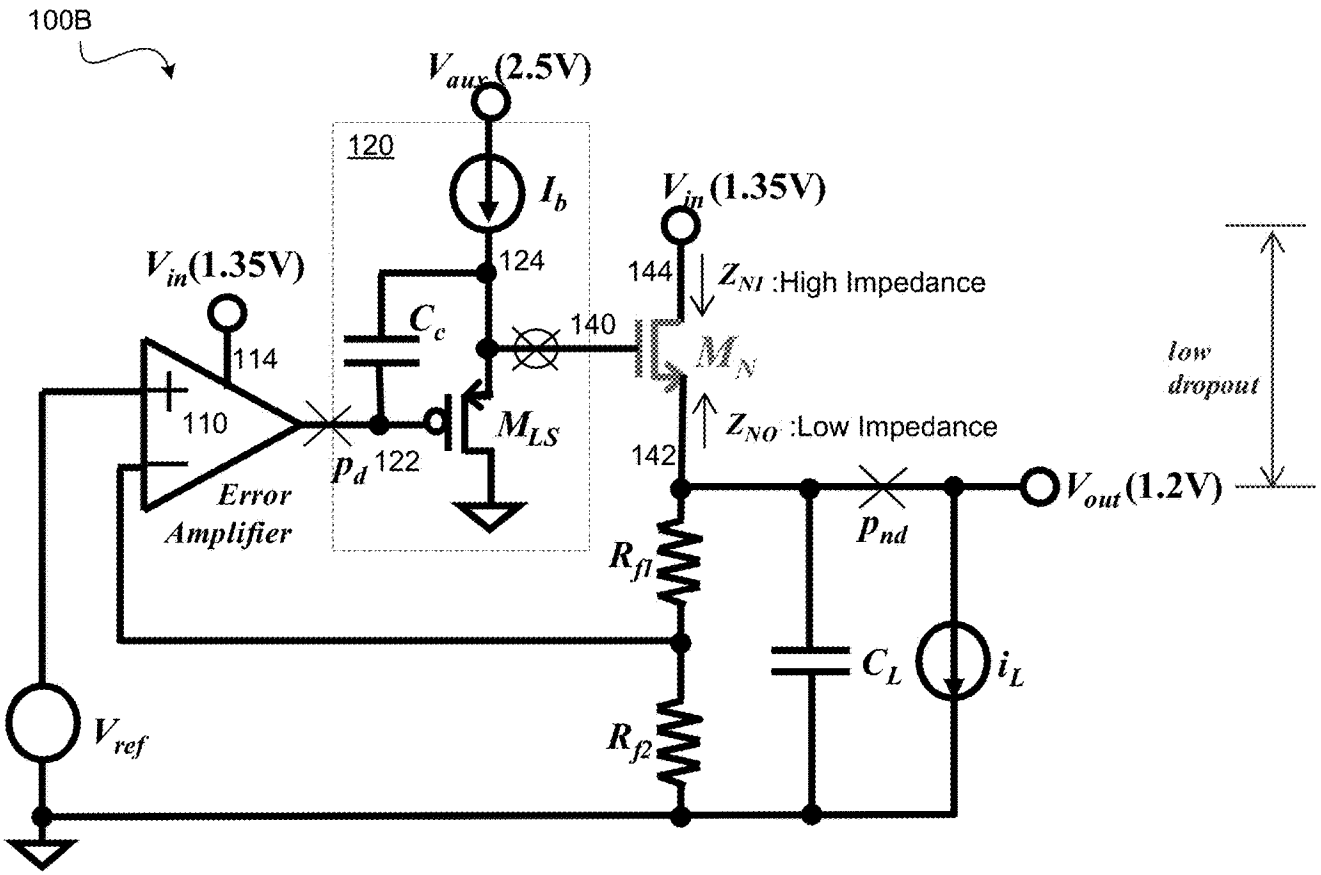

FIGS. 1A-1B illustrate examples of a low-power low-dropout (LDO) voltage regulator device 100A in accordance with one or more implementations of the subject technology. In one or more implementations, the LDO voltage regulator device 100A (hereinafter "device 100A") includes an error amplifier 110, a level-shifter circuit 120 and a pass transistor $M_N$ (e.g., a NMOS pass transistor $M_N$, hereinafter "transistor $M_N$"). The error amplifier 110 compares a sampled portion of a regulated output voltage $V_{out}$ (e.g., 1.2 V) of the LDO voltage regulator device 110A with a reference voltage $V_{ref}$ and generates an error signal 112. The level-shifter circuit 120 is coupled to the error amplifier 110, and can shift a voltage level of the error signal 112 to facilitate the low dropout operation of the transistor $M_N$. A gate node 140 of the transistor $M_N$ is coupled to the level-shifter circuit.

The regulated output voltage $V_{out}$ can be provided at a source node 142 of the transistor $M_N$. An advantage of using the transistor $M_N$ is that the regulated output voltage $V_{out}$ can be provided with low dropout (e.g., 0.15V) and high power-supply rejection (PSR). Further, a low output impedance of the transistor $M_N$ (e.g., at node 142) can result in a high unity-gain-bandwidth (UGB) performance of the device 100A, which can improve the settling time of the device 100A by more than approximately 60%, for both dips and overshoots of the output voltage.

In one or more implementations, the sampled portion of the regulated output voltage $V_{out}$ that is compared by the reference voltage $V_{ref}$ is generated by a voltage divider formed by the resistors $R_{f1}$ and $R_{f2}$. The load capacitor $C_L$, in conjunction with the resistors $R_{f1}$ and $R_{f2}$, provides low-pass filtering of the regulated output voltage $V_{out}$ and can include a capacitance of the load. The load current is shown as a current source $i_L$ in parallel with load capacitor $C_L$.

In one or more implementations, as shown in FIG. 1B, the level-shifter circuit 120 of an LDO voltage regulator device 100B (hereinafter "device 100B") includes a source follower circuit. The level-shifter circuit 120 can provide the suitable level shift to properly bias the transistor $M_N$. The voltage at the gate node 140 of the transistor $M_N$ equals $V_{gsN}+V_{out}$, and the level-shifter circuit 120 can provide such a voltage. An auxiliary supply voltage $V_{aux}$ (e.g., at 2.5 V) has to be used to provide the sufficient voltage at the gate node 140. The source follower circuit can be formed by a transistor $M_{LS}$ (e.g., a PMOS transistor $M_{LS}$, hereinafter "transistor $M_{LS}$"), a compensation capacitor $C_c$, and a current source $I_b$. The current source $I_b$ is coupled between a source node 124 of the transistor $M_{LS}$ and an auxiliary supply voltage $V_{aux}$ (e.g., at 2.5 V) and provide a bias current for the source node 124 of the transistor $M_{LS}$. In some implementations, a power supply node 114 of the error amplifier 110 and a drain node 144 of the transistor MN can be coupled to a low-dropout input voltage supply (Vin, e.g., at 1.35 V) of the device 100B.

Since, the gate voltage Vg, at the node 140, contributes to a non-dominant pole ($P_{nd}$), a large biasing current (e.g., $I_b$) is needed to push this pole far away from loop's UGB to guarantee a reliable stability. However, the large biasing current $I_b$ can result in additional power consumption of the level-shifter circuit 120, which is undesirable. The subject technology, avoids using a large biasing current $I_b$, by using the compensation capacitor $C_c$. The compensation capacitor $C_c$ is coupled between a gate node 122 and the source node 124 of the transistor $M_{LS}$. The compensation capacitor $C_c$ allows low-current operation of the level-shifter circuit 120. The low-current operation is made possible by cancellation of a $p_{nd}$ at the gate node 140 of the transistor $M_N$, which is connected to the source node 124 of the transistor $M_{LS}$.

The high PSR (e.g., approximately 10 dB at 100 MHz) performance of the devices 100A and 100B can be supported by the high input impedance of the transistor $M_N$ (e.g., at node 144). The high input impedance (e.g., $1/g_{dsN}$) provides a desirable isolation of the transistor $M_N$ from the supply voltage (e.g., the input voltage supply). The high PSR performance is highly important for rejection of power supply ripples, which can adversely affect proper operation of radio-frequency (RF) and analog signal circuitry. The subject technology provides the high PSR performance while consuming significantly lower power than the existing high PSR solutions, and having a substantially lower settling time (e.g., approximately 60% lower dip and overshoot settling time).

The lower settling time is a result of the high UGB performance. The high UGB performance of the devices 100A and 100B, can be understood by the low output impedance of the transistor $M_N$. The output impedance of the transistor $M_N$, as seen from the source node 142 of the transistor $M_N$, is defined by $1/g_{mN}$, which with suitable biasing of the transistor $M_N$, can be sufficiently small to warrant a high UGB performance of the devices 100A and 100B. Existing solutions using PMOS pass transistor, instead of the NMOS pass transistor $M_N$, suffer from large output impedance (e.g., $1/g_{dsP}$ of the PMOS pass transistor), which results in a low UGB performance and a long settling time.

Figure 2:
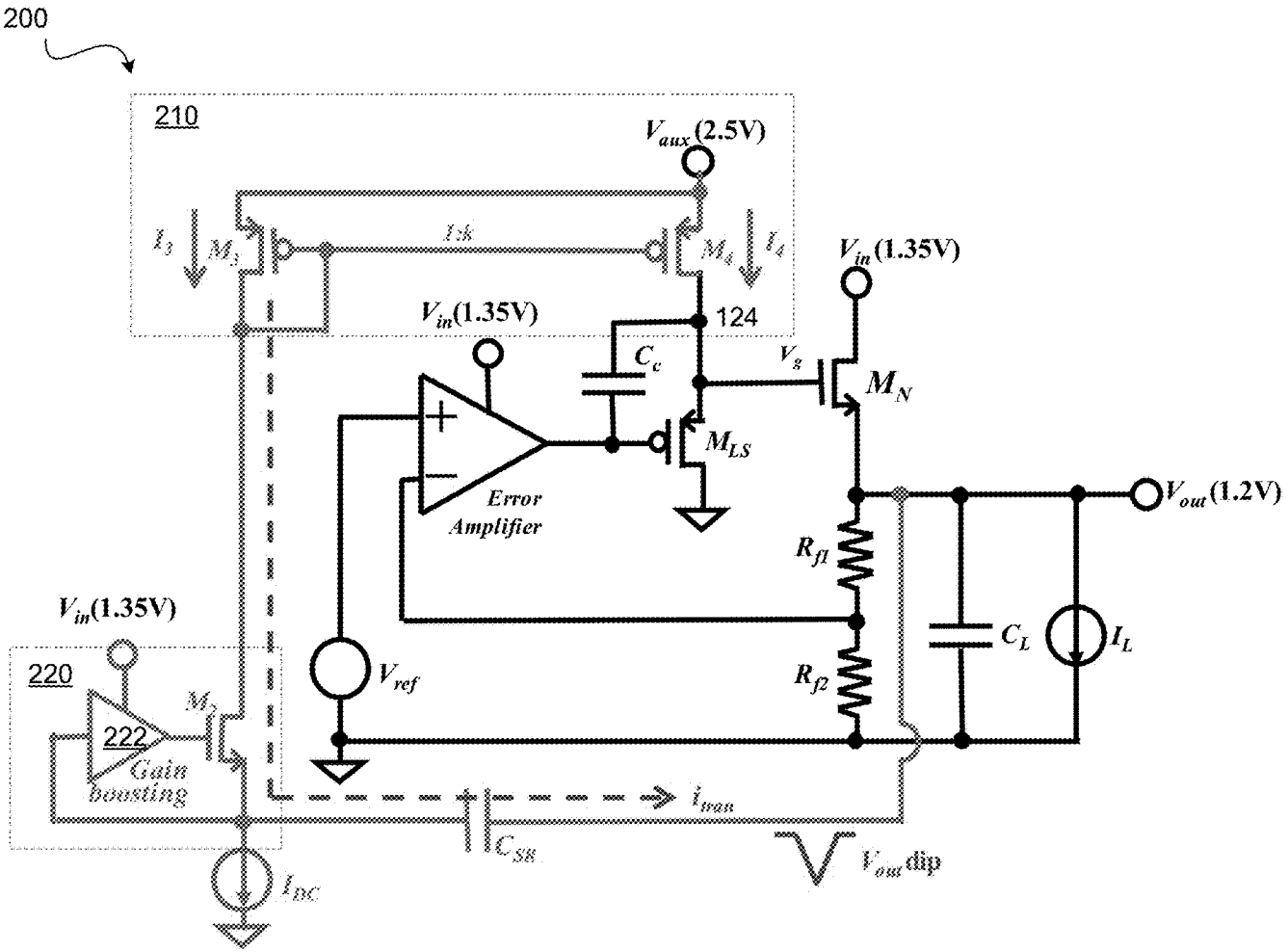
FIG. 2 illustrates an example of a low-power LDO voltage regulator device including a fast loop in accordance with one or more implementations.

FIG. 2 illustrates an example of a low-power LDO voltage regulator device 200 including a fast loop in accordance with one or more implementations of the subject technology. The low-power LDO voltage regulator device 200 (hereinafter "device 200") is similar to the device 100A, except for the addition of the fast loop as described herein. In some implementations, the fast loop includes a current mirror 210 coupled to the level-shifter circuit 120 (e.g., to the source node 124 of the transistor $M_{LS}$) and a gain boosting circuit 220. The fast loop can improve the transient response-time and the slew rate of the device 200. The current mirror 210 is formed by transistors (e.g., PMOS transistors) $M_3$ and $M_4$ and provides a bias current $I_4$ (replacing the current source $I_b$ of FIG. 1B) by mirroring a current $I_3$ (e.g., $I_4=k\ I_3$). The current $I_3$ is approximately equal to the current source $I_{DC}$. The fast loop consumes very low DC current, as the biasing current $I_4$ can be a small current, due to the use of the compensation capacitance $C_c$, as discussed above.

In one or more implementations, the gain boosting circuit 220 includes a gain boosting amplifier 222 coupled to a gate node of a transistor M2 (e.g., an NMOS transistor). The gain boosting amplifier 222 is biased by the input supply voltage Vin (e.g., 1.35V). The gain boosting circuit 220 can increase the fast loop bandwidth, thereby improving the transient response-time and the slew rate of the device 200. A coupling capacitor $C_{SR}$ is used by the fast loop to sense undesirable transients (e.g., dips or overshoots) in the regulated output voltage (e.g., $V_{out}$). Based on the transients in the regulated output voltage, the gain boosting circuit 220 can adjust a source current provided to the level-shifter circuit (e.g., the source node of the transistor $M_{LS}$) by adding a transient current component $i_{tran}$ to the biasing current $I_4$. The transient current component $i_{tran}$ can substantially suppress dips and overshoot of the regulated output voltage.

Figure 3:
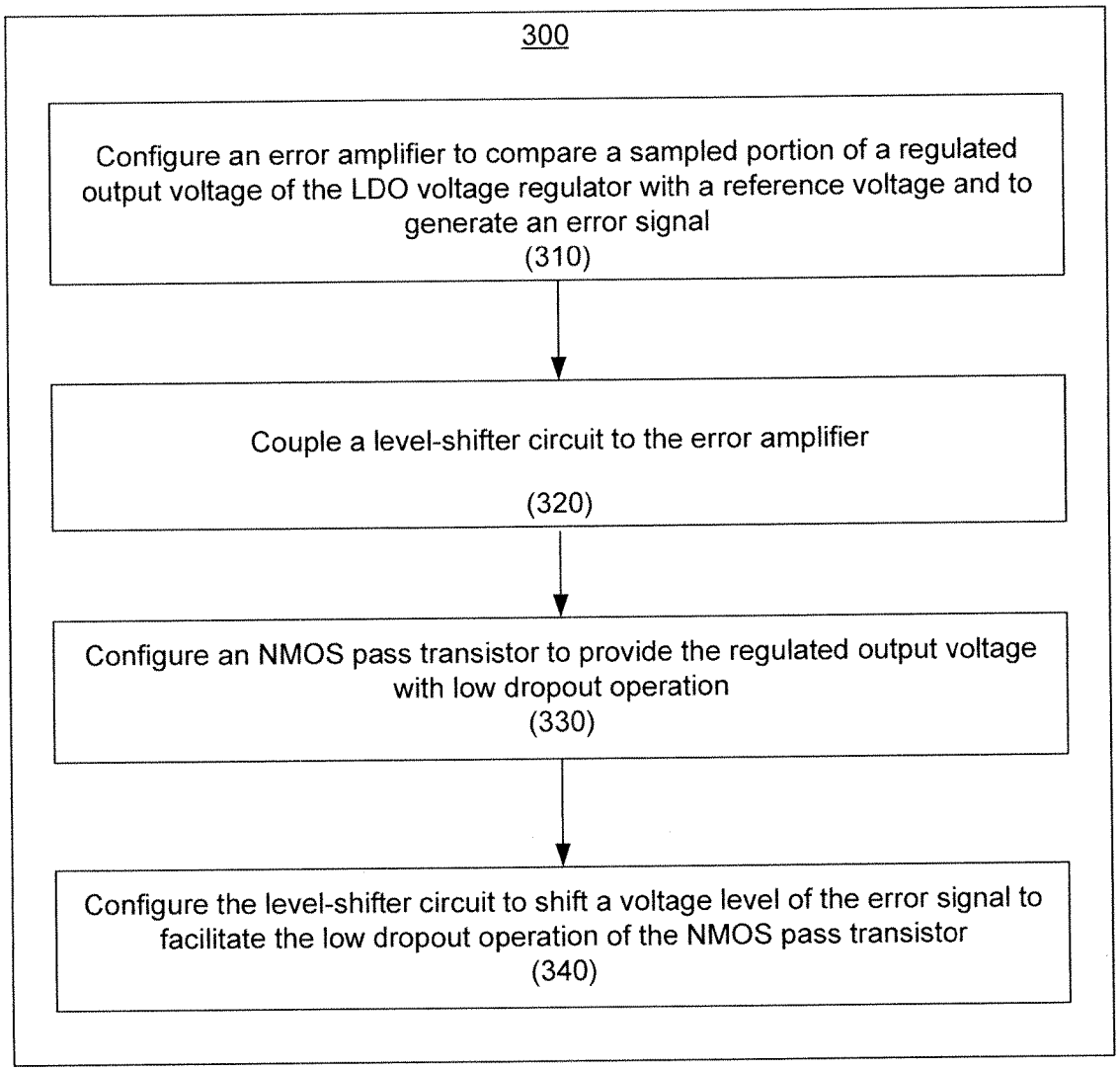
FIG. 3 illustrates an example of a method for providing a low-power LDO voltage regulator device in accordance with one or more implementations.

FIG. 3 illustrates an example of a method 300 for providing a low-power LDO voltage regulator device in accordance with one or more implementations of the subject technology. For explanatory purposes, the example method 300 is described herein with reference to, but is not limited to, the device 100A of FIG. 1A. Further for explanatory purposes, the blocks of the example method 300 are described herein as occurring in serial, or linearly. However, multiple blocks of the example method 300 can occur in parallel. In addition, the blocks of the example method 300 need not be performed in the order shown and/or one or more of the blocks of the example method 300 need not be performed.

The methods 300 includes configuring an error amplifier (e.g., 110 of FIG. 1A) to compare a sampled portion (e.g., sampled by 130 of FIG. 1A) of a regulated output voltage (e.g., Vout of FIG. 1A) of the LDO voltage regulator (e.g., 100A of FIG. 1A) with a reference voltage (e.g., Vref of FIG. 1A) and to generate an error signal (e.g., 112 of FIG. 1A) (310). A level-shifter circuit (e.g., 120 of FIGS. 1A-1B) may be coupled to the error amplifier (320). An NMOS pass transistor (e.g., $M_N$ of FIG. 1A) is configured to provide the regulated output voltage with low dropout operation (330). The level-shifter circuit is configured to shift a voltage level of the error signal to facilitate the low dropout operation of the NMOS pass transistor (340).

Figure 4:
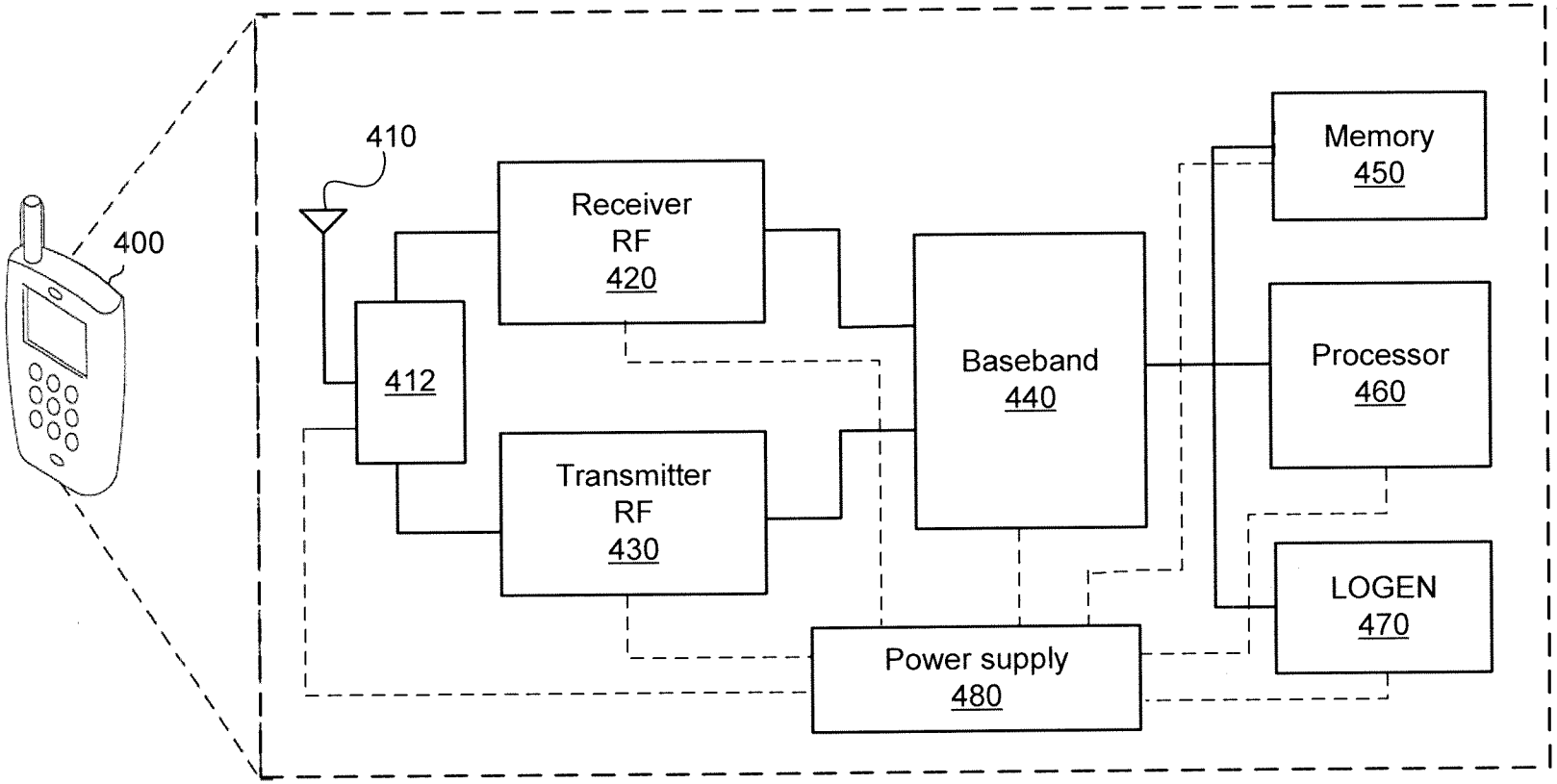
FIG. 4 illustrates an example of a wireless communication device in accordance with one or more implementations.

FIG. 4 illustrates an example of a wireless communication device 400 in accordance with one or more implementations of the subject technology. The wireless communication device 400 can comprise a radio-frequency (RF) antenna 410, a receiver 420, a transmitter 430, a baseband processing module 440, a memory 450, a processor 460, a local oscillator generator (LOGEN) 470, and a power supply 480. In various embodiments of the subject technology, one or more of the blocks represented in FIG. 4 can be integrated on one or more semiconductor substrates. For example, the blocks 420-470 can be realized in a single chip or a single system on chip, or can be realized in a multi-chip chipset.

The RF antenna 410 can be suitable for transmitting and/or receiving RF signals (e.g., wireless signals) over a wide range of frequencies. Although a single RF antenna 410 is illustrated, the subject technology is not so limited.

The receiver 420 comprises suitable logic circuitry and/or code that can be operable to receive and process signals from the RF antenna 410. The receiver 420 may, for example, be operable to amplify and/or down-covert received wireless signals. In various embodiments of the subject technology, the receiver 420 is operable to cancel noise in received signals and can be linear over a wide range of frequencies. In this manner, the receiver 420 is suitable for receiving signals in accordance with a variety of wireless standards. Wi-Fi, WiMAX, Bluetooth, and various cellular standards.

The transmitter 430 comprises suitable logic circuitry and/or code that can be operable to process and transmit signals from the RF antenna 410. The transmitter 430 may, for example, be operable to up-covert baseband signals to RF signals and amplify RF signals. In various embodiments of the subject technology, the transmitter 430 is operable to up-convert and to amplify baseband signals processed in accordance with a variety of wireless standards. Examples of such standards include Wi-Fi, WiMAX, Bluetooth, and various cellular standards. In various embodiments of the subject technology, the transmitter 430 is operable to provide signals for further amplification by one or more power amplifiers.

The duplexer 412 provides isolation in the transmit band to avoid saturation of the receiver 420 or damaging parts of the receiver 420, and to relax one or more design requirements of the receiver 420. Furthermore, the duplexer 412 can attenuate the noise in the receive band. The duplexer is operable in multiple frequency bands of various wireless standards.

The baseband processing module 440 comprises suitable logic, circuitry, interfaces, and/or code that can be operable to perform processing of baseband signals. The baseband processing module 440 may, for example, analyze received signals and generate control and/or feedback signals for configuring various components of the wireless communication device 400 such as the receiver 420. The baseband processing module 440 is operable to encode, decode, transcode, modulate, demodulate, encrypt, decrypt, scramble, descramble, and/or otherwise process data in accordance with one or more wireless standards.

The processor 460 comprises suitable logic, circuitry, and/or code that can enable processing data and/or controlling operations of the wireless communication device 400. In this regard, the processor 460 is enabled to provide control signals to various other portions of the wireless communication device 400. The processor 460 can also control transfers of data between various portions of the wireless communication device 400. Additionally, the processor 460 can enable implementation of an operating system or otherwise execute code to manage operations of the wireless communication device 400.

The memory 450 comprises suitable logic, circuitry, and/or code that can enable storage of various types of information such as received data, generated data, code, and/or configuration information. The local oscillator generator (LOG EN) 470 comprises suitable logic, circuitry, interfaces, and/or code that can be operable to generate one or more oscillating signals of one or more frequencies. The LOGEN 470 can be operable to generate digital and/or analog signals. In this manner, the LOGEN 470 can be operable to generate one or more clock signals and/or sinusoidal signals. Characteristics of the oscillating signals such as the frequency and duty cycle can be determined based on one or more control signals from, for example, the processor 460 and/or the baseband processing module 440.

In operation, the processor 460 can configure the various components of the wireless communication device 400 based on a wireless standard according to which it is desired to receive signals. Wireless signals can be received via the RF antenna 410 and amplified and down-converted by the receiver 420. The baseband processing module 440 can perform noise estimation and/or noise cancellation, decoding, and/or demodulation of the baseband signals. In this manner, information in the received signal can be recovered and utilized appropriately. For example, the information can be audio and/or video to be presented to a user of the wireless communication device, data to be stored to the memory 450, and/or information affecting and/or enabling operation of the wireless communication device 400. The baseband processing module 440 can modulate, encode and perform other processing on audio, video, and/or control signals to be transmitted by the transmitter 430 in accordance to various wireless standards.

The power supply 480 can provide one or more regulated rail voltages (e.g., $V_{DD}$) for various circuitries of the wireless communication device 400. In one or more implementations, the power supply 480 can include a low-power low-dropout (LDO) voltage regulator device (e.g., 100B of FIG. 1B) of the subject technology. In some aspects, the power supply 480 can include a low-power low-dropout (LDO) voltage regulator device with a low-current fast loop (e.g., see 200 of FIG. 2) disclosed above, which can improve a transient response-time and a slew rate of the power supply 480.

Those of skill in the art would appreciate that the various illustrative blocks, modules, elements, components, and methods described herein can be implemented as electronic hardware, computer software, or combinations of both. To illustrate this interchangeability of hardware and software, various illustrative blocks, modules, elements, components, and methods have been described above generally in terms of their functionality. Whether such functionality is implemented as hardware or software depends upon the particular application and design constraints imposed on the overall system. Skilled artisans can implement the described functionality in varying ways for each particular application. Various components and blocks can be arranged differently (e.g., arranged in a different order, or partitioned in a different way) all without departing from the scope of the subject technology.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

A phrase such as "an aspect" does not imply that such aspect is essential to the subject technology or that such aspect applies to all configurations of the subject technology. A disclosure relating to an aspect can apply to all configurations, or one or more configurations. An aspect can provide one or more examples of the disclosure. A phrase such as an "aspect" refers to one or more aspects and vice versa. A phrase such as an "embodiment" does not imply that such embodiment is essential to the subject technology or that such embodiment applies to all configurations of the subject technology. A disclosure relating to an embodiment can apply to all embodiments, or one or more embodiments. An embodiment can provide one or more examples of the disclosure. A phrase such an "embodiment" can refer to one or more embodiments and vice versa. A phrase such as a "configuration" does not imply that such configuration is essential to the subject technology or that such configuration applies to all configurations of the subject technology. A disclosure relating to a configuration can apply to all configurations, or one or more configurations. A configuration can provide one or more examples of the disclosure. A phrase such as a "configuration" can refer to one or more configurations and vice versa.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include," "have," or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein can be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A low-power low-dropout (LDO) voltage regulator device, the device comprising:

an error amplifier configured to compare a sampled portion of a regulated output voltage of the LDO voltage regulator device with a reference voltage and to generate an error signal at a single-ended output node of the error amplifier;

a level-shifter circuit coupled to the error amplifier;

a fast loop comprising a current mirror and a gain boosting circuit coupled to the level-shifter circuit and configured to improve a transient response-time and a slew rate of the LDO voltage regulator device; and an NMOS pass transistor configured to provide the regulated output voltage with low dropout operation, wherein the level-shifter circuit comprises a source follower including a PMOS transistor and is configured to shift a voltage level of the error signal at the single-ended output node of the error amplifier to facilitate the low dropout operation of the NMOS pass transistor, and wherein a gate terminal of the NMOS pass transistor is connected to an output node of the source follower.

2. The LDO voltage regulator device of claim 1, wherein the NMOS pass transistor is configured to achieve a high input impedance that results in a high power supply rejection (PSR) performance of the LDO voltage regulator device, wherein the high PSR comprises approximately 10 dB at 100 MHz.

3. The LDO voltage regulator device of claim 1, wherein the NMOS pass transistor is configured with a low output impedance that results in a high unity-gain-bandwidth (UGB) performance of the LDO voltage regulator device.

4. The LDO voltage regulator device of claim 3, wherein achieving the high UGB results in an improvement of more than 60% in a settling time of the LDO voltage regulator device, and wherein the settling time of the LDO voltage regulator device comprises dip-settling time and overshoot-settling time of the LDO voltage regulator device.

5. The LDO voltage regulator device of claim 1, wherein the level-shifter circuit comprises a compensation capacitor coupled between a gate terminal and a source terminal of the PMOS transistor.

6. The LDO voltage regulator device of claim 5, wherein the compensation capacitor is configured to allow low-current operation of the level-shifter circuit by cancellation of a non-dominant pole at the gate terminal of the NMOS pass transistor.

7. The LDO voltage regulator device of claim 1, wherein the fast loop further comprises a coupling capacitor that is used by the fast loop to sense a transient in the regulated output voltage, and wherein the fast loop is configured to increase a current provided to the level-shifter circuit by modification of a transient current that is generated based on the regulated output voltage.

8. A method for providing a low-power low-dropout (LDO) voltage regulator, the method comprising:

configuring an error amplifier to compare a sampled portion of a regulated output voltage of the LDO voltage regulator with a reference voltage and to generate an error signal at a single-ended output node of the error amplifier;

coupling a level-shifter circuit comprising a source follower including a PMOS transistor to the error amplifier;

coupling a fast loop comprising a current mirror and a gain boosting circuit to the level-shifter circuit and configuring the fast loop to improve a transient response-time and a slew rate of the LDO voltage regulator; and configuring an NMOS pass transistor to provide the regulated output voltage with low dropout operation; and configuring the level-shifter circuit to shift a voltage level of the error signal at the single-ended output node of the error amplifier to facilitate the low dropout operation of the NMOS pass transistor, wherein a gate terminal of the NMOS pass transistor is connected to an output node of the source follower.

9. The method of claim 8, wherein the fast loop further comprises a coupling capacitor that is used by the fast loop to sense a transient in the regulated output voltage, and wherein the fast loop is configured to increase a current provided to the level-shifter circuit by modification of a transient current that is generated based on the regulated output voltage.

10. The method of claim 8, further comprising configuring the NMOS pass transistor to achieve a high input impedance that results in a high power supply rejection (PSR) performance of the LDO voltage regulator, wherein the high PSR comprises approximately 10 dB at 100 MHz.

11. The method of claim 8, further comprising configuring the NMOS pass transistor with a low output impedance that results in a high unity-gain-bandwidth (UGB) performance of the LDO voltage regulator.

12. The method of claim 11, further comprising improving a settling time of the LDO voltage regulator by more than 60% by achieving the high UGB, and wherein the settling time of the LDO voltage regulator device comprises a dip-settling time and an overshoot-settling time of the LDO voltage regulator.

13. The method of claim 8, wherein coupling the level-shifter circuit comprises coupling a compensation capacitor between a gate terminal and a source terminal of the PMOS transistor.

14. The method of claim 13, further comprising configuring the compensation capacitor to allow low-current operation of the level-shifter circuit by cancellation of a non-dominant pole at the gate terminal of the NMOS pass transistor.

15. A communication device, comprising:

a low-power low-dropout (LDO) voltage regulator device comprising:

an error amplifier configured to generate an error signal at a single-ended output node of the error amplifier based on a comparison between a sampled portion of a regulated output voltage of the LDO voltage regulator and a reference voltage;

an NMOS pass transistor configured to provide the regulated output voltage with low dropout operation;

a level-shifter circuit coupled to the error amplifier and the NMOS pass transistor and configured to shift a voltage level of the error signal at the single-ended output node of the error amplifier to facilitate the low dropout operation of the NMOS pass transistor, wherein the level-shifter circuit comprises a source follower including a PMOS transistor, and wherein a gate terminal of the NMOS pass transistor is connected to an output node of the source follower; and a fast loop comprising a current mirror and a gain boosting circuit coupled to the level-shifter circuit and configured to improve a transient response-time and a slew rate of the LDO voltage regulator device.

16. The communication device of claim 15, wherein the NMOS pass transistor is configured with a low output impedance that results in a high unity-gain-bandwidth (UGB) performance of the LDO voltage regulator device.

17. The communication device of claim 16, wherein achieving the high UGB results in an improvement of more than 60% in a settling time of the LDO voltage regulator device, and wherein the settling time comprises dip-settling time and overshoot-settling time.

18. The communication device of claim 15, wherein:

the NMOS pass transistor is configured to achieve a high input impedance that results in a high power supply rejection (PSR) performance of the LDO voltage regulator device, and the high PSR comprises approximately 10 dB at 100 MHz.

19. The communication device of claim 15, wherein:

the level-shifter circuit comprises a compensation capacitor coupled between a gate terminal and a source terminal of the PMOS transistor, and the compensation capacitor is configured to allow low-current operation of the level-shifter circuit by cancellation of a non-dominant pole at the gate terminal of the NMOS pass transistor.

20. The communication device of claim 15, wherein:

the fast loop comprises:

a coupling capacitor that is used by the fast loop to sense a transient in the regulated output voltage, and wherein the fast loop is configured to increase a current provided to the level-shifter circuit by modification of a transient current that is generated based on the regulated output voltage.

* * * * *